US008033774B2

(12) United States Patent
Rajewski

(10) Patent No.: US 8,033,774 B2
(45) Date of Patent: Oct. 11, 2011

(54) SECURE REAR-LOADING MATERIAL HANDLING APPARATUS SYSTEM

(76) Inventor: David E. Rajewski, Spokane, WA (US)

( * ) Notice: Subject to any disclaimer, the term of this patent is extended or adjusted under 35 U.S.C. 154(b) by 387 days.

(21) Appl. No.: 11/904,024

(22) Filed: Sep. 25, 2007

(65) Prior Publication Data

US 2009/0081016 A1 Mar. 26, 2009

(51) Int. Cl.
*B65F 3/02* (2006.01)

(52) U.S. Cl. ..... 414/408; 293/118; 414/525.2; 414/501

(58) Field of Classification Search ..... 414/408, 414/422, 501, 519, 525.2, 525.5, 525.9, 556; 293/118, 119; 298/1 B, 18
See application file for complete search history.

(56) References Cited

U.S. PATENT DOCUMENTS

| | | | | | |
|---|---|---|---|---|---|
| 2,252,608 | A | * | 8/1941 | Ballert | 414/472 |
| 2,672,363 | A | * | 3/1954 | Buchanan | 293/118 |
| 3,083,849 | A | * | 4/1963 | Mottin | 414/406 |
| 3,355,044 | A | * | 11/1967 | Nelson | 414/501 |
| 3,616,950 | A | * | 11/1971 | Coons | 414/517 |
| 4,886,411 | A | * | 12/1989 | Pieperhoff et al. | 414/408 |
| 4,991,890 | A | * | 2/1991 | Paulson | 293/118 |
| 5,344,273 | A | * | 9/1994 | Radlein | 414/409 |
| 5,588,711 | A | * | 12/1996 | Hall | 298/18 |
| 5,613,823 | A | * | 3/1997 | Bayne | 414/408 |
| 5,749,630 | A | * | 5/1998 | Ung | 298/18 |
| 5,772,385 | A | * | 6/1998 | Huntoon et al. | 414/408 |

FOREIGN PATENT DOCUMENTS

| | | | | | |
|---|---|---|---|---|---|
| DE | 3424797 | A1 | * | 1/1986 | 414/408 |
| EP | 0405428 | A1 | * | 1/1991 | 414/408 |
| GB | 2141978 | A | * | 1/1985 | 293/118 |

* cited by examiner

*Primary Examiner* — James Keenan
(74) *Attorney, Agent, or Firm* — Wells St. John PS

(57) ABSTRACT

This invention in some embodiments includes a secure material handling apparatus such as a vehicle which provides rear loading of material from material containers, and in some further embodiments provides for such rear loading from curbside or ground level, or from a loading dock. In further embodiments the enclosure utilized is secure in that it may be configured to prevent unauthorized entry into any part of the vehicle.

8 Claims, 19 Drawing Sheets

SECURE REAR-LOADING MATERIAL HANDLING APPARATUS SYSTEM

CROSS REFERENCE TO RELATED APPLICATION

This application does not claim priority from any other application.

TECHNICAL FIELD

This invention relates to a material handling vehicle system for providing a rear loading and secure material handling apparatus or vehicle system, and may include embodiments which are capable of loading at ground level and from a traditional elevated loading dock.

BACKGROUND OF THE INVENTION

Traditional material handling apparatuses and vehicles, which may for instance be trailers for operative connection to trucks or cabs, compactor trucks, have been around for many years to receive, compact, haul and dump paper, feedstock and garbage, among other items. In many applications of material handling systems to documents, or feedstock, it may in a given application be preferred to haul the documents, paper or feedstock to a remote location for shredding or other disposal. During the loading, transportation and other handling of the documents, paper and feedstock, a higher level of security may be desired or required to protect the information embodied in these documents and feedstock.

With traditional compactor trucks, such as garbage trucks, the material or feedstock such as paper is not secure and may easily be blown out or escape, thereby making its contents available to others in the vicinity. With prior material handling vehicles, it is also easily possible for third parties to gain access to the vehicle when it is temporarily unmanned or otherwise available for entry, because there is insufficient security or denial of access to the interior of the vehicle.

To further establish the need for something new, there have been several more recent laws and regulations that impact the security requirements for various types of documents and information (banking and health care records being two examples). It has therefore become more important than ever for companies to be provide more secure hauling and/or compacting of material such as documents and other feedstock requiring security.

There are also multiple types of locations and configurations of locations from which material must be picked up for later delivery, such as from a curbside and from a loading dock. Furthermore many of the areas from which material must be picked up have narrow streets in space limitations on the size and configuration of the material handling vehicle; and some of these limitations make it problematic for side loading material handling vehicles. It is therefore preferred in many such situations to provide a rear loading material handling vehicle capable of loading material containers, and compacting the material received from said containers into an interior storage compartment.

Once the material handling vehicle is ready to have the loaded material removed, it is desirable to provide such removal in an efficient manner so that significant manual labor for instances not required.

For the security reasons it is often times desirable to have such a material handling apparatus or vehicle configured such that the emptying of the material containers is accomplished substantially within the enclosure such as the container, box or trailer.

It is an object of some embodiments of this invention to provide a rear loading material handling and secure vehicle system for receiving material from material containers.

It is also an object of some embodiments of this invention to provide an improved material handling apparatus or vehicle which may load material from material containers from the rear of the vehicle system, and from either a curbside or ground level location and from a loading dock location.

While the invention was motivated in addressing some objectives, it is in no way so limited. The invention is only limited by the accompanying claims as literally worded, without interpretative or other limiting reference to the specification, and in accordance with the doctrine of equivalents.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings:

FIG. 4 is an elevation view showing the hopper feed system from FIG. 3, as the material container is raised for dumping material into the hopper;

FIG. 16 is perspective view of a vehicle container or box which may be utilized in some embodiments of this invention, illustrating one example of how the container or enclosure sidewall may be opened to allow material to be dumped or removed from the container;

FIG. 17 is a rear perspective view of the hopper feed system relative to the interior cavity of the vehicle container, illustrating material being compacted or pushed into the interior cavity of the vehicle container;

FIG. 19 is a perspective view of another example of a material handling system which may be utilized in practicing this invention, wherein the bumper portions slide relative to the vehicle and one another.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
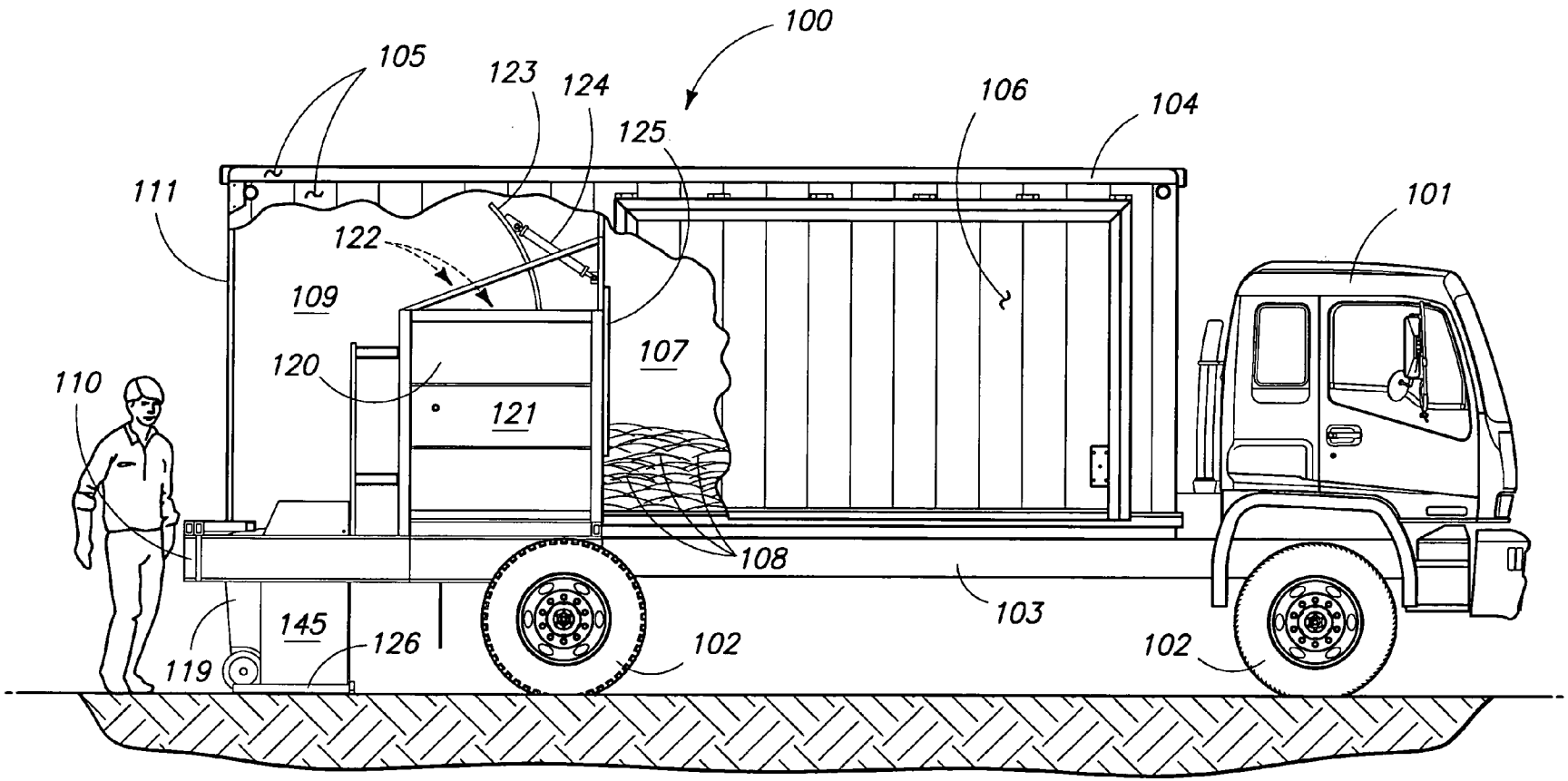
FIG. 1 is an elevation view of one embodiment of a secure rear loading material handling vehicle system contemplated by this invention, showing the material containers loaded from ground level.

FIG. 1 is an elevation view of one embodiment of a secure rear loading material handling vehicle system 100 contemplated by this invention, showing the material containers 119 loaded from ground level. FIG. 1 shows truck cab 101, tires 102, framework 103 or chassis, and rear bumper 110. The container, box or trailer portion of the truck is shown with outer surface 105, top side 104, first side 106, rear side 111, and an interior cavity defined by two compartments in this embodiment, namely a material loading compartment 109 and a storage compartment 107. A hopper 120 is shown with hopper wall 121 and hopper opening 122 or aperture through which material is deposited from material containers 119.

Hopper top 123 is pivotally mounted relative to hopper 120 and powered by a hydraulic cylinder 124 to open it to receive material as indicated by arrows 122, and then to close it for movement or compacting of the material into storage compartment 107, the stored material 108 shown within storage compartment 107. Material container carriage 145 is shown with material container 119 and bottom portion 126 for loading the material container 119. FIG. 1 further shows slide door 125 which may operate by sliding up and down to open and close an aperture between hopper 120 and storage compartment 107 or storage portion of the enclosure, as is illustrated more fully in later figures.

The storage compartment 107, or storage portion of the enclosure, is toward the front end of the enclosure 100 and the material loading compartment 109, or the material loading portion of the enclosure, is toward the rear end of the enclosure, as this is a rear loading material handling apparatus.

It will be appreciated by those of ordinary skill in the art that one advantageous aspect of embodiments of this invention includes the ability to load material containers 119 or material in general from either the ground level or from a loading dock level which would be at the level of the rear bumper 110.

It will also be appreciated that while the embodiments shown herein are integral with a vehicle, namely a truck, this invention is not so limited and may without limitation be provided on a trailer for pulling by a tractor or cab type of vehicle, or a fifth-wheel type of configuration, with no one in particular being required to practice this invention.

Figure 2:
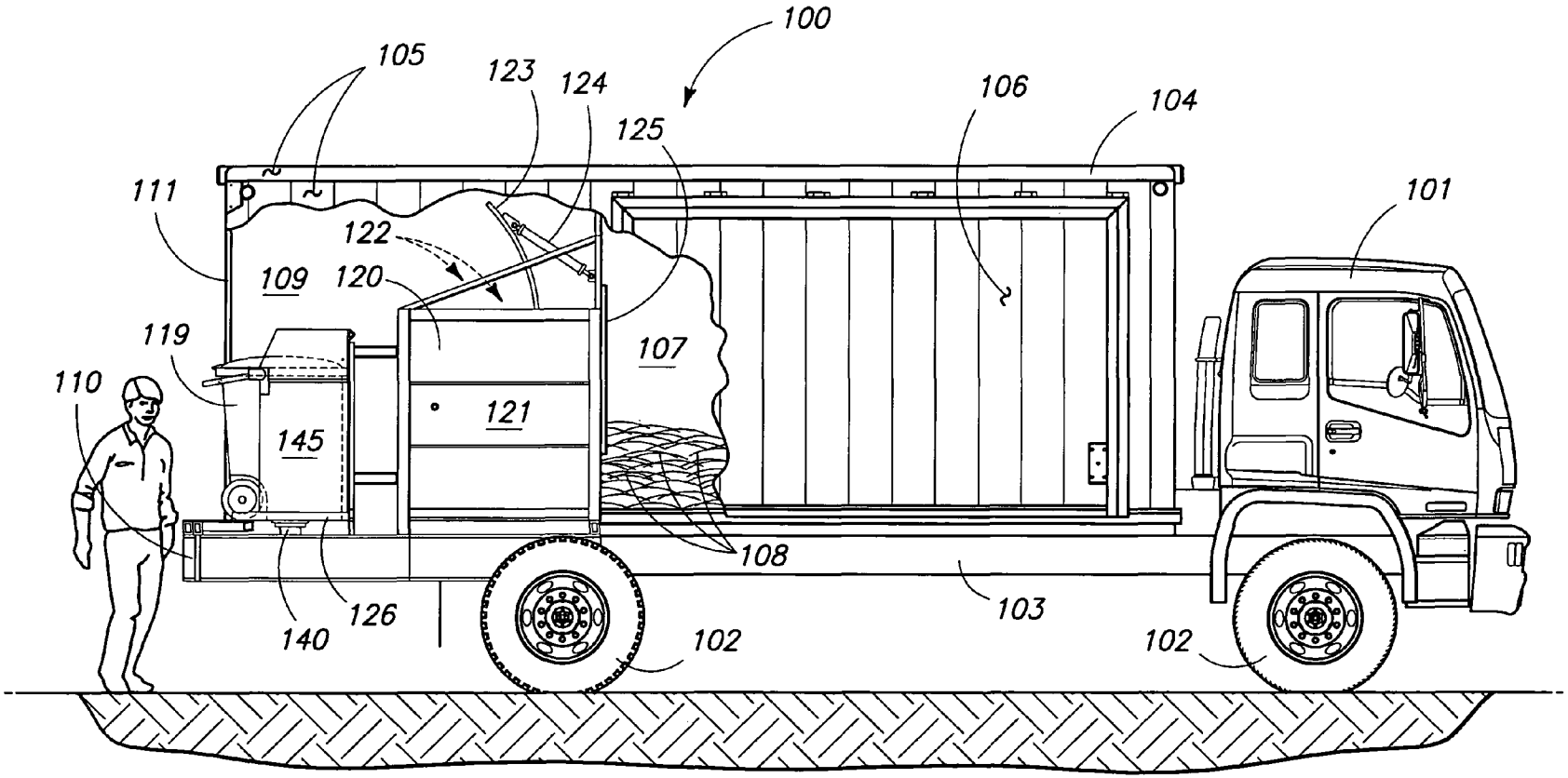
FIG. 2 is a elevation view of the embodiment of the vehicle system shown in FIG. 1, further showing the material containers within the material feed portion of the enclosure as it may be loaded from a loading dock level.

FIG. 2 is a elevation view of the embodiment of the vehicle system shown in FIG. 1, further showing the material containers within the feed area. The items shown in FIG. 2 are similarly numbered as those shown in FIG. 1, and each will not repeatedly referenced herein to avoid duplication. FIG. 2 shows material container 119 within material container carriage 145 in the position that would be approximately level with most commercial loading docks, and which better facilitates the loading and unloading from an elevated position relative to the ground level. The versatility of embodiments of this invention as a result of its ability to load from either the ground level or a loading dock level may be advantageous depending on the application of the embodiments and depending on the versatility requirements for the specific application.

Figure 3:
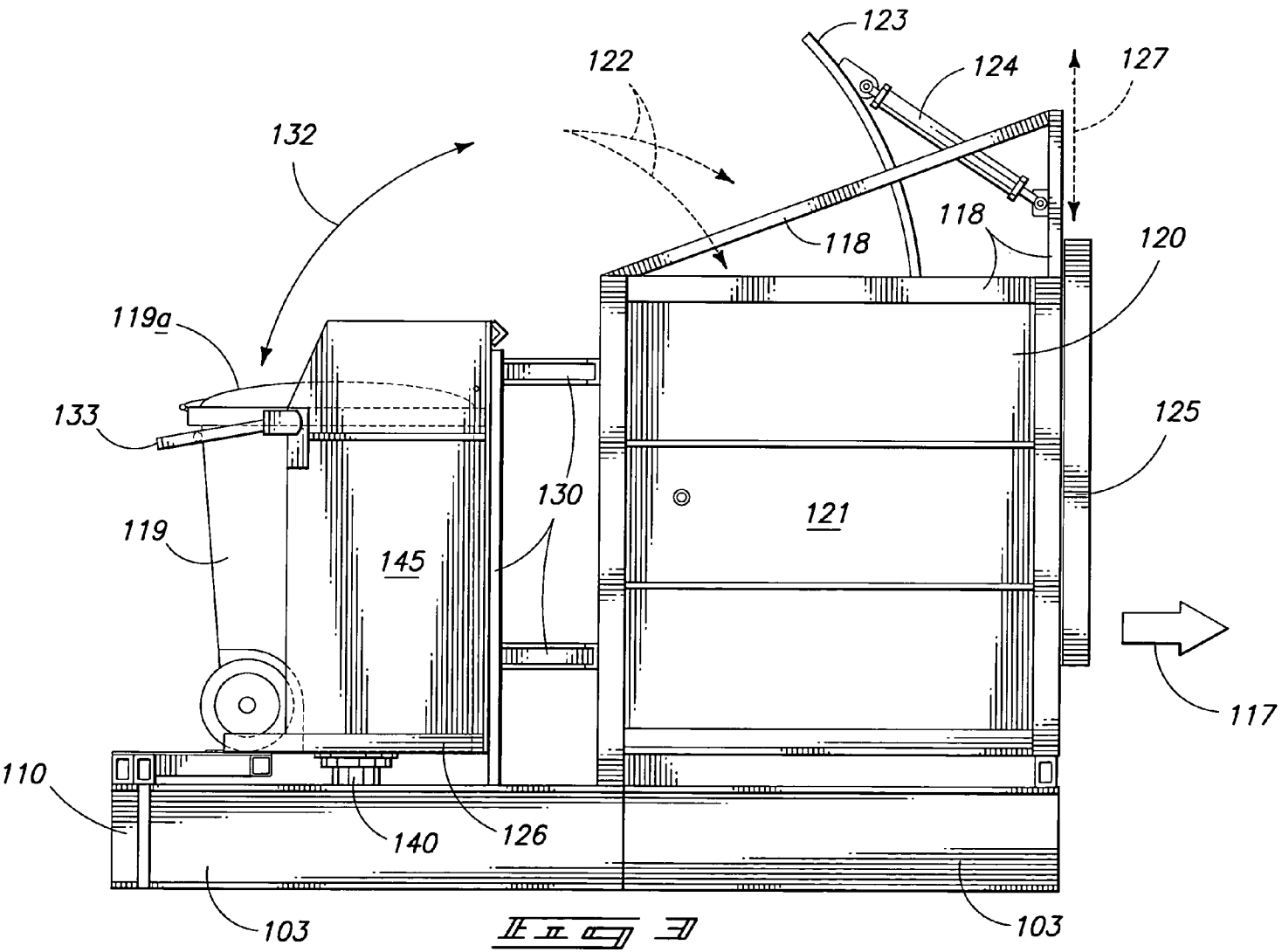
FIG. 3 is an elevation view of one embodiment of a hopper feed system which may be utilized in this invention.

FIG. 3 is an elevation view of one embodiment of a hopper feed system which may be utilized in this invention. FIG. 3 illustrates vehicle framework 103, rear bumper 110, material container 119, material container carriage 145, retainer bar 133, material container lid 119*a*, hopper sidewall 121, hopper framework 118, material container carriage 145 lifts 140 with bottom portion 126 of material container carriage 145. Framework 130 provides point of attachment and relative positioning for the material container carriage 145 relative to the hopper 120. Arrow 127 illustrates the vertical movement of slide door 125, with arrow 117 indicating the direction that material would travel to go from the internal cavity of the hopper 122 to the storage compartment (shown in other figures). Arrow 132 shows the direction of movement that material container 129 is taken through by carriage 145 in order to position it above hopper 124 for the dumping of material from material container 119 into the interior cavity of hopper 120.

FIG. 4 is an elevation view showing the hopper feed system as illustrated in FIG. 3, as the material container is raised for dumping material into the inlet of the hopper. FIG. 4 includes many items shown and described in FIG. 3 and each will not therefore be repeated here to avoid needless repetition. FIG. 4 illustrates the movement of carriage 145 as indicated by arrow 141 and powered by hydraulic cylinder 140 with hydraulic ram 140*a*. As carriage 145 is lifted, retainer bar 133 holds material container lid 119*a* open so that material within material container 119 may be dumped into hopper 120 as indicated by arrow 122. Arrow 143 shows the relative movement of material container lid 119*a* to open it and arrow 132 shows the relative direction of movement of the material container 119 as powered by the hydraulic cylinder 140.

Figure 5:
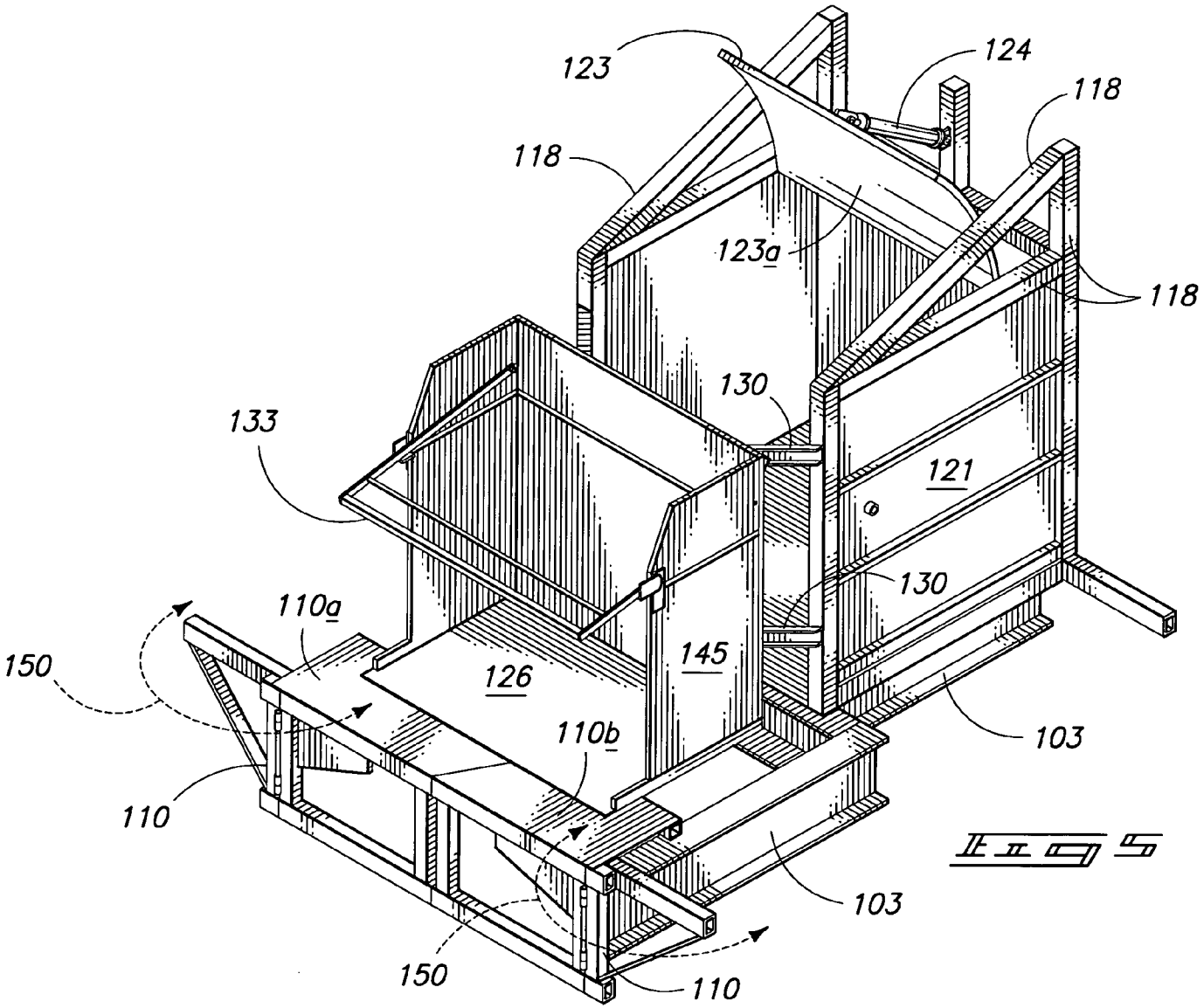
FIG. 5 is a perspective view of the embodiment of the hopper feed system shown in FIG. 3, and further illustrating one embodiment of a vehicle bumper system which may be utilized, wherein the bumper portions may be rotated to allow the material container carriage to be lowered to ground level.

FIG. 5 is a perspective view of the embodiment of the hopper feed system shown in FIG. 3, and further illustrating one embodiment of a vehicle bumper system which may be utilized, wherein the bumper portions may be rotated to allow the material container carriage to be lowered to ground level. FIG. 5 illustrates hopper framework 118, hopper top 123 with inner surface 123*a*, hopper top 123 being pivotally mounted relative to the hopper and it's relative movement is powered by hydraulic cylinder 124. Material container carriage 145 has bottom portion 126, which is shown sitting on or above bumpers 110. In this position (which may also be referred to as the loading dock position), material containers on a loading dock may be easily placed within carriage 145 by raising retainer bar 133.

Arrows 150 show how bumper portions 110 are pivotally mounted to the vehicle framework 103 such that they may be utilized to support carriage 145 and then rotated out of the way to allow carriage 145 to be lowered to ground level to load material containers at ground level in addition to being able to load material containers at a loading dock level. First bumper portion 110*a* rotates clockwise in the drawing and second bumper portion 110*b* rotates counterclockwise relative to vehicle framework 103 with both rotations indicated by arrow 150. The versatility provided which allows embodiments of this invention to load and unload material containers from either ground level or from loading dock level has advantages in many applications.

Figure 6:
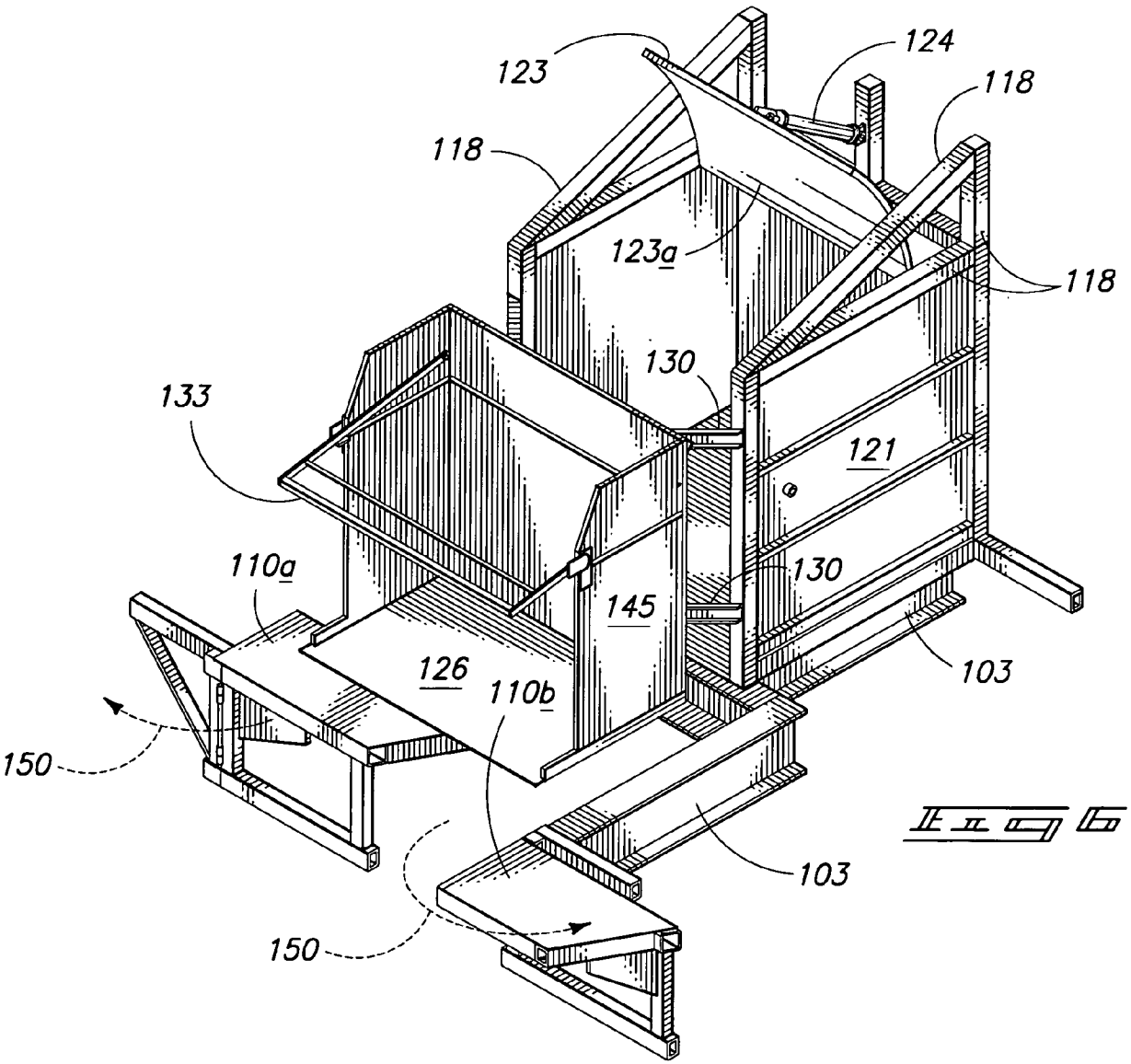
FIG. 6 is the perspective view of the embodiment of the hopper feed system shown in FIG. 5 with one of the vehicle bumper portions rotated outwardly to illustrate how that would allow the material container carriage to be lowered to ground level.

FIG. 6 is the perspective view of the embodiment of the hopper feed system shown in FIG. 5 with one of the vehicle bumper portions rotated outwardly to illustrate how that would allow the material container carriage to be lowered to ground level. FIG. 6 has many items which are like numbered to those shown in FIG. 5 and they will therefore not be restated here to avoid repetition. FIG. 6 illustrates how second bumper portion 110*b* has been rotated counterclockwise as indicated by arrow 150 to a position where it would not prevent carriage 145 from being lowered to ground level.

Figure 7:
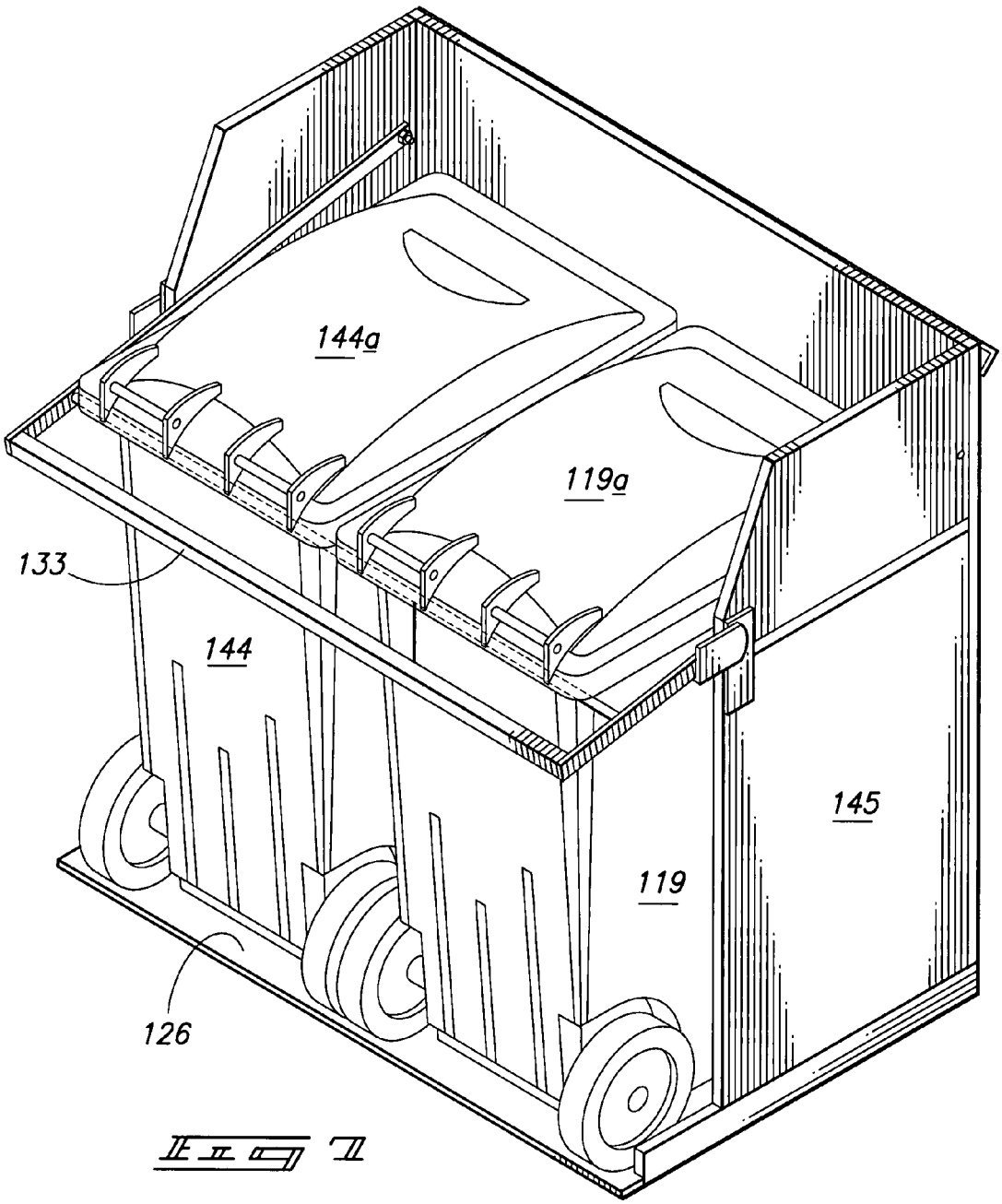
FIG. 7 is a perspective view of one embodiment of a material container carriage which may be utilized in practicing this invention.

FIG. 7 is a perspective view of one embodiment of a material container carriage which may be utilized in practicing this invention. FIG. 7 illustrates material container carriage 145 with material containers 119 and 114, each with material container lids 119*a* and 114*a* respectively. Carriage 145 includes retainer bar 133 which may be utilized to assist in the opening or pivoting the material container lids 119*a* and 144*a* respectively. Carriage bottom 126 provides the support and surface upon which material containers 119 and 144 may be supported.

Figure 8B:
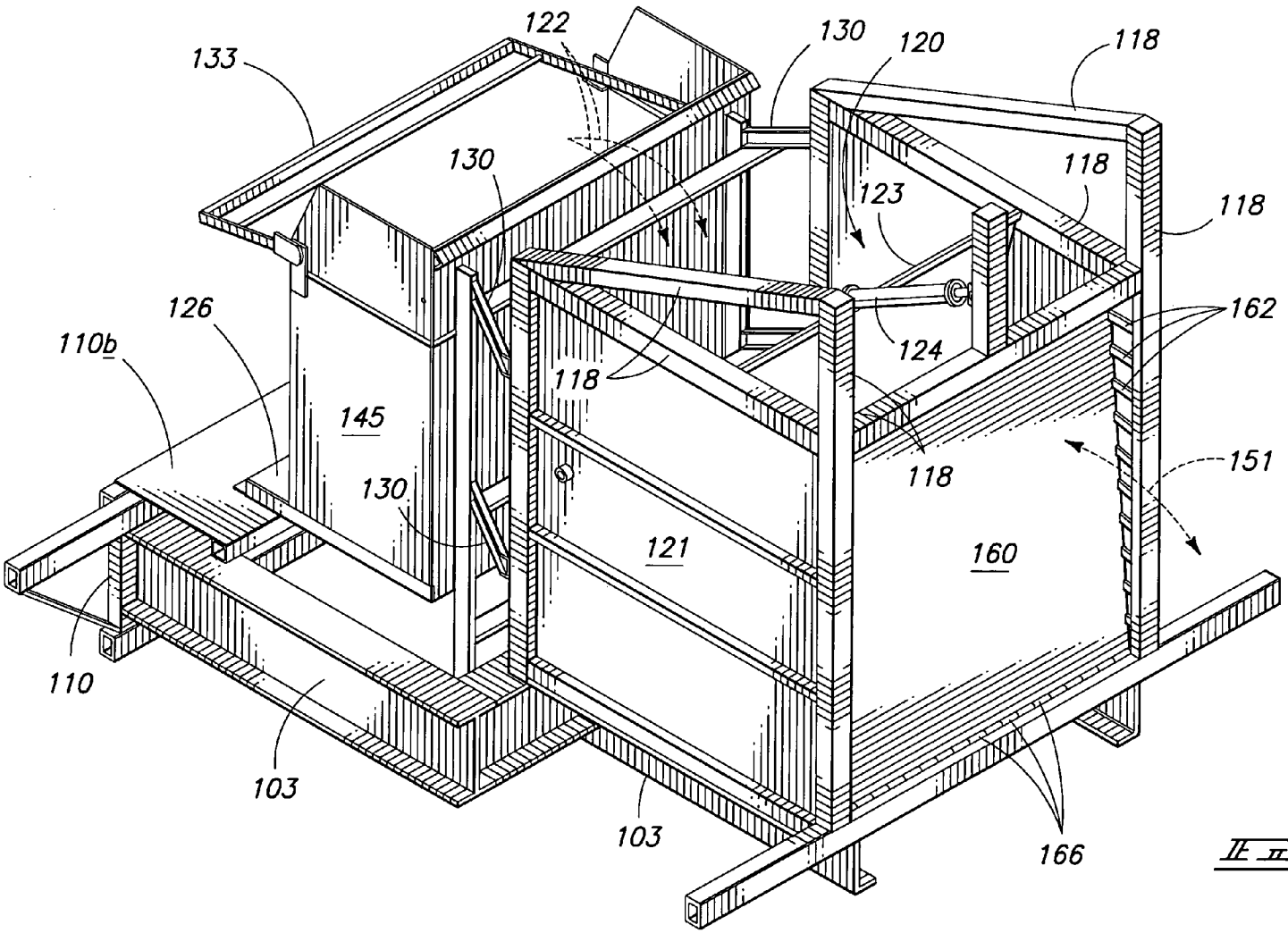
FIG. 8 is a rear perspective view of the hopper feed system illustrated in FIG. 5.

FIG. 8 is a rear perspective view of the hopper feed system illustrated in FIG. 5. FIG. 8 shows vehicle framework 103, rear bumper 110, rear bumper second portion 110*b*, carriage 145, carriage bottom 126, framework connectors 130 between carriage 145 and hopper 120. FIG. 8 further illustrates hopper framework 118, hopper wall 121, compactor 160 in the upright position as pivoted about hinge 166, which is illustrated by arrow 151. Protrusions 162 or rails in the hopper wall opposite to hopper wall 121 interact with grooves in compactor wall 162 to help avoid paper getting caught between the hopper walls and the compactor 160 sidewalls.

FIG. 8 further shows hydraulic cylinder 124 holding hopper top 123 downward such that it provides an upper surface or guide for compactor 160 as it is pivoted about hinge 166 upwardly to discharge and compact material from the hopper 120 into the storage compartment in the vehicle enclosure, which is further shown in other drawings. It will be noted that no one particular type or configuration of hopper feed system need be used to practice this invention, but instead any one of a number or combinations of hopper feed systems may be utilized within the contemplation of this invention.

Figure 9:
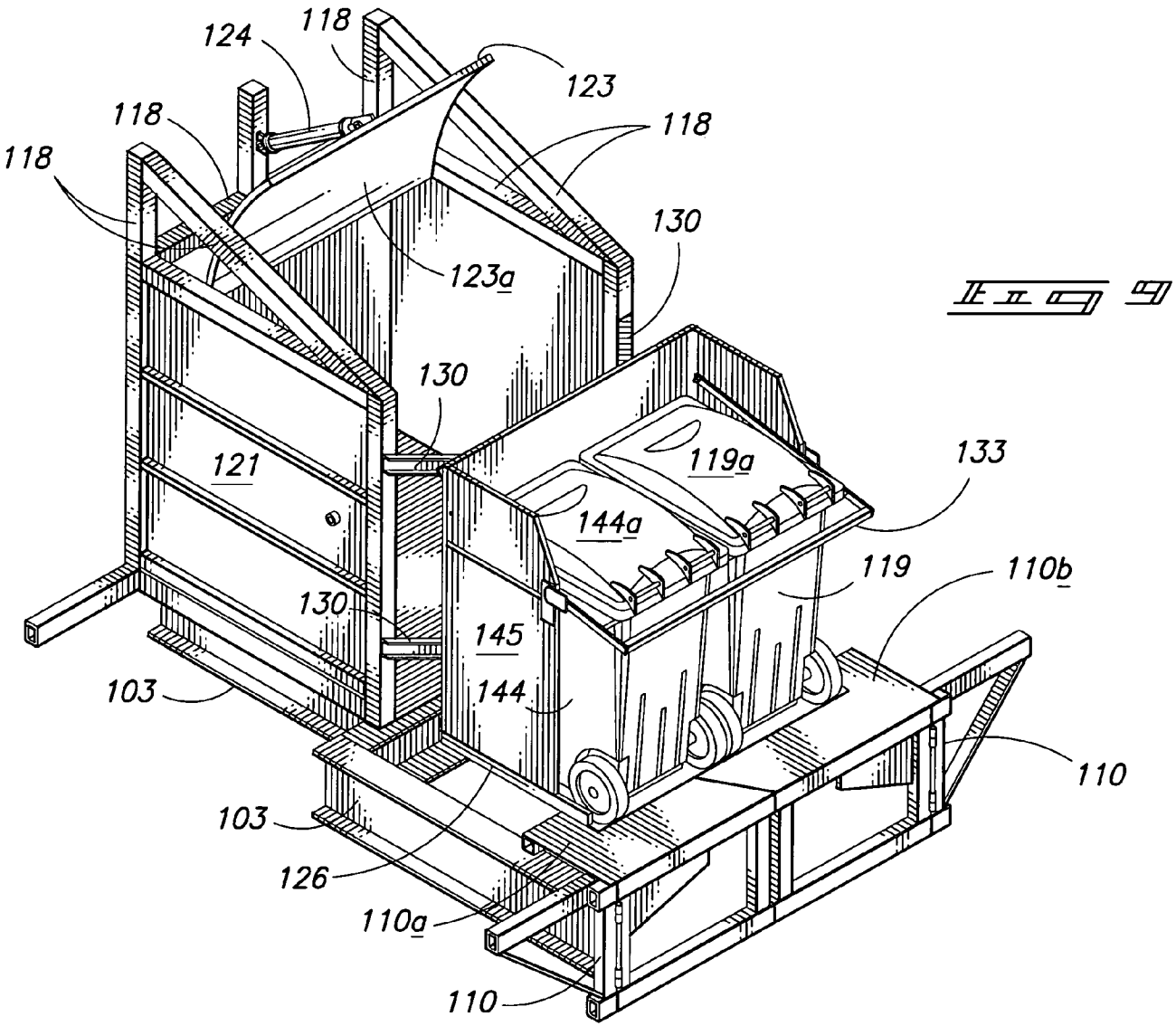
FIG. 9 is a perspective view of the hopper feed system illustrated in FIG. 5 with the hopper open to receive material from the material containers.

FIG. 9 is a perspective view of the hopper feed system illustrated in FIG. 5 with the hopper open and ready to receive material from the material containers. FIG. 9 contains numerous items which are like items to those in prior figures and each will not be restated here to avoid unnecessary repetition. FIG. 9 illustrates first bumper portion 110*a* and second bumper portion 110*b* in the support position for carriage 145 and in a position to load and unload from a loading dock at an elevated level from ground level. FIG. 9 illustrates hopper top 123 with top surface 123*a* in the open position as controlled by hydraulic cylinder 124.

Figure 10:
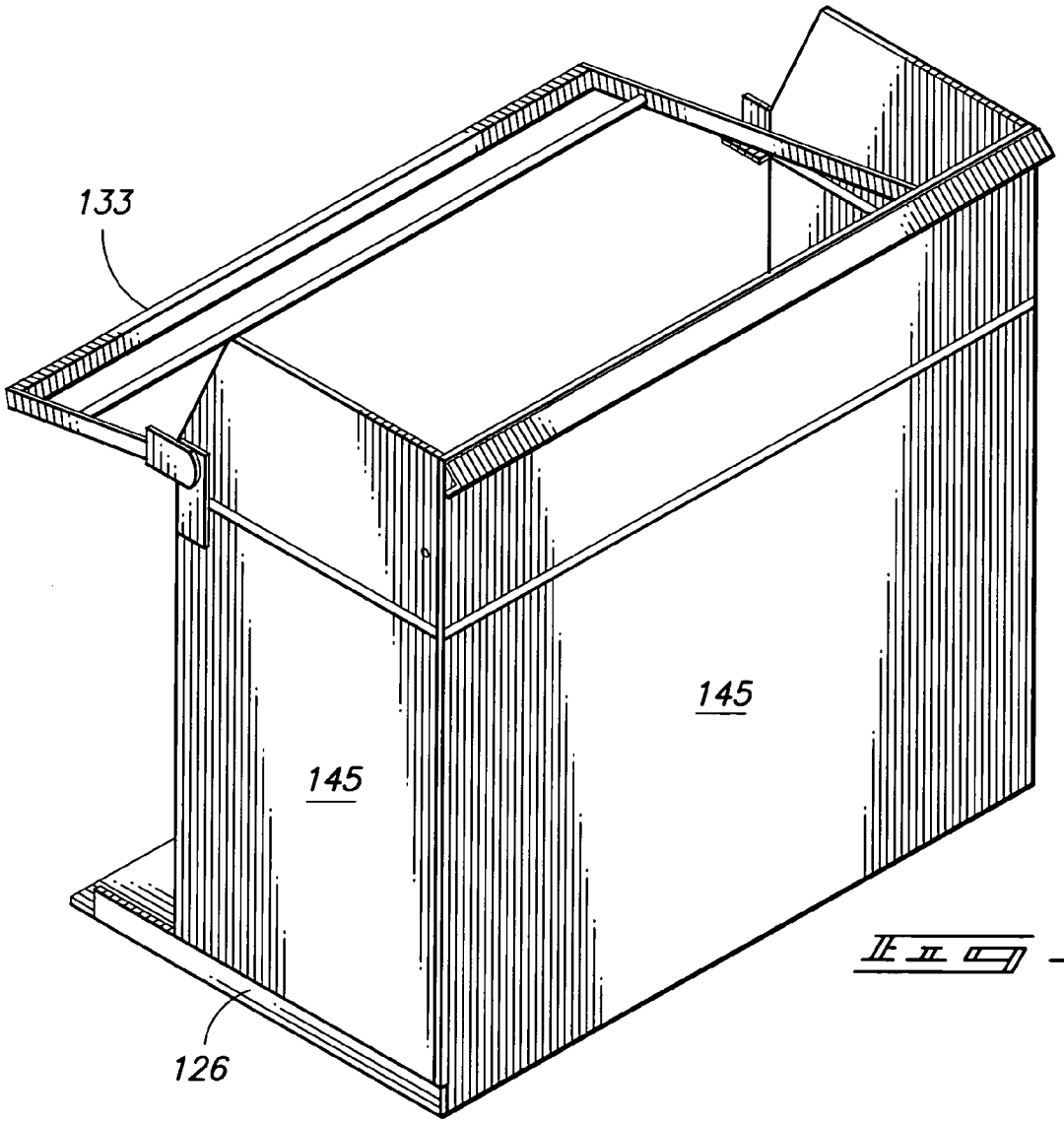
FIG. 10 is a rear perspective view of one example of an embodiment of a material container carriage which may be utilized in practicing this invention.
Figure 11:
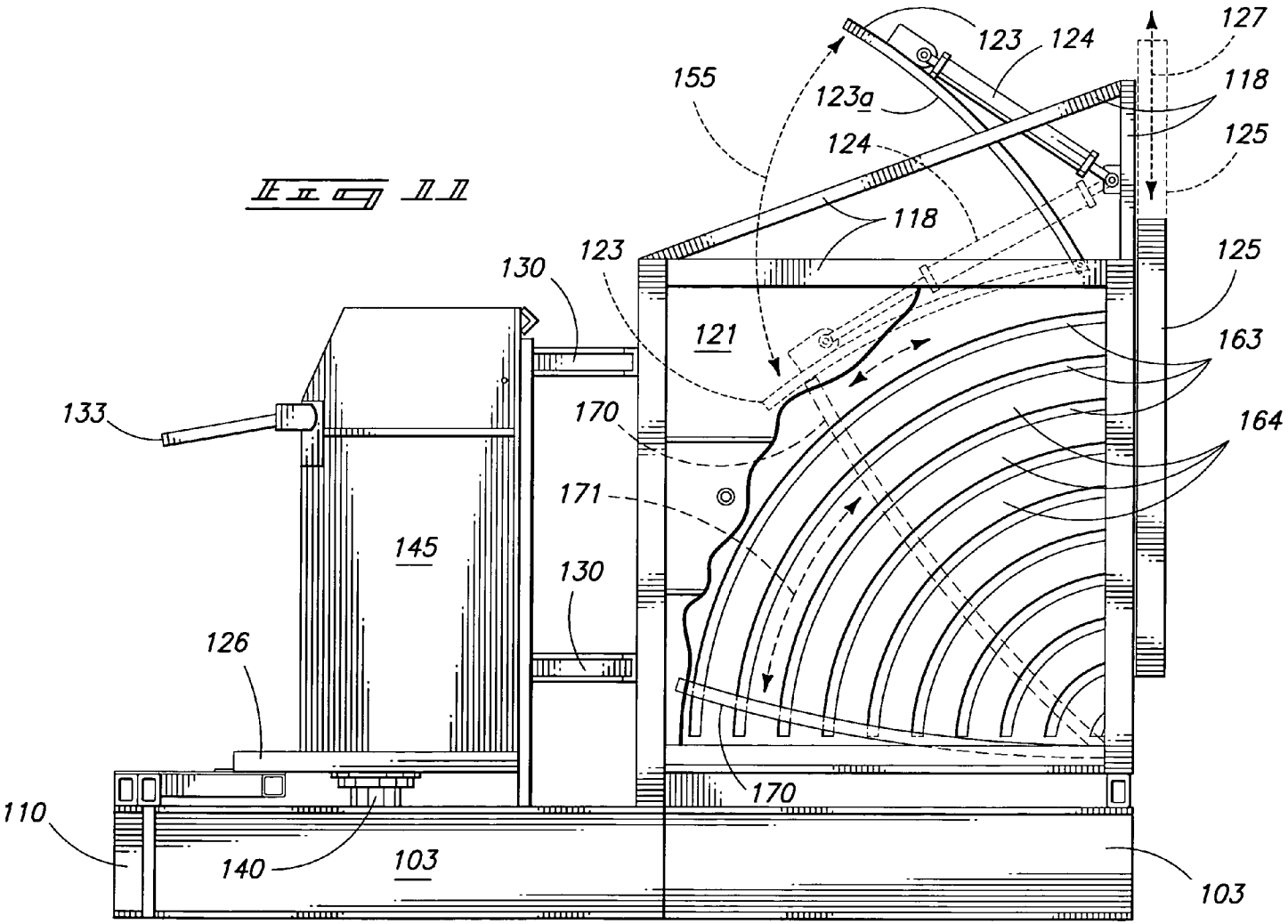

FIG. 10 is a rear perspective view of one example of an embodiment of a material container carriage which may be utilized in practicing this invention. FIG. 10 illustrates material container carriage 145, retainer bar 133 and bottom 126. It will be appreciated by those of ordinary skill in the art that the container or framework may be any one of a number of different types and need not have solid walls, but instead could be more of a framework, so long as it acted as a support carriage to lift the material containers as shown and described in prior figures, with no one configuration of carriage being required to practice this invention.

Figure 11:
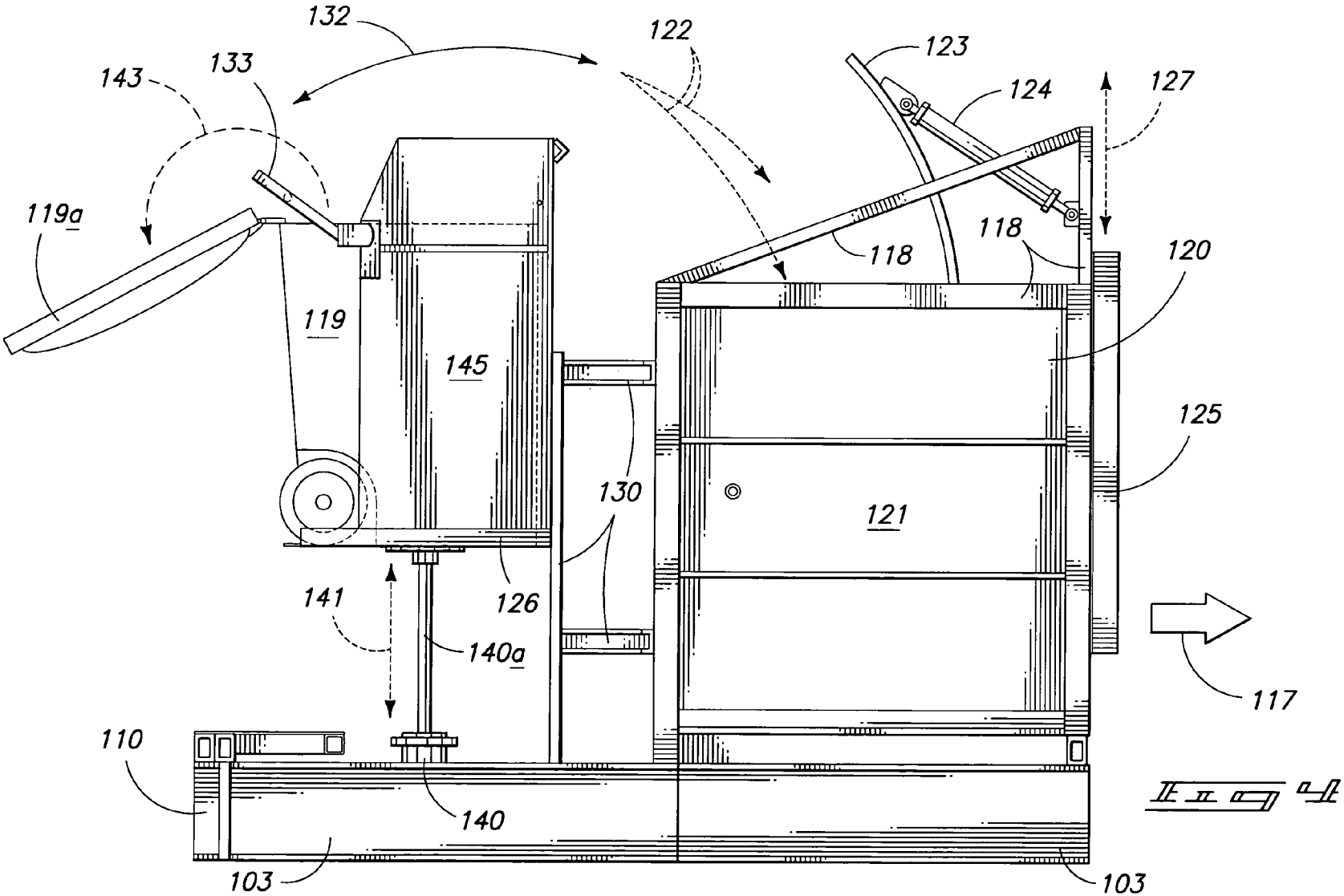
FIG. 11 is a side elevation view of the embodiment of the hopper feed system illustrated in FIG. 5, showing the compactor and groove system that may be utilized in embodiments of this invention.

FIG. 11 is a side elevation view of the embodiment of the hopper feed system illustrated in FIG. 5, showing the compactor and groove system that may be utilized in embodiments of this invention. FIG. 11 better illustrates the movement of compactor 170 as indicated by arrow 171 and shows hopper wall 164 with protrusions 163 therein. FIG. 11 illustrates sliding wall 125 which slides as shown by arrow 127 relative to the hopper framework 118 to open and close the hopper discharge aperture between the hopper and the storage compartment, which is shown and described in other figures. FIG. 11 further shows how hopper top 123 is pivotally rotated downward as indicated by arrow 155 to a position where it is positioned relative to the moving compactor 172 act as a guide and container for material which is being compacted and/or moved from the interior cavity of the hopper to the storage compartment within the storage portion of the enclosure.

Hopper top 123 is in the upward or open position to allow material to be dumped into the hopper, and then is closed once it is desired to pivotally move the compactor 172 to move material from the hopper. It will be appreciated that compactor 170 is a compactor or material mover and may be moved by any one of a number of different means or ways, such as a hydraulic cylinder position beneath the compactor, or by other means and ways, all within the contemplation of this invention, with no one in particular being required to practice different embodiments of this invention.

The compactor 170 is a material movement device and is one of a number of different types of material movement devices which may be utilized in practicing embodiments of this invention. While some material movement devices may include compaction, compaction is not required. Furthermore the movement of the material from the hopper area may be accomplished in other ways in different embodiments of the invention, such as by push-rams, augurs and other ways known generally in the art, with no one in particular being required to practice embodiments of the invention.

Figure 12:
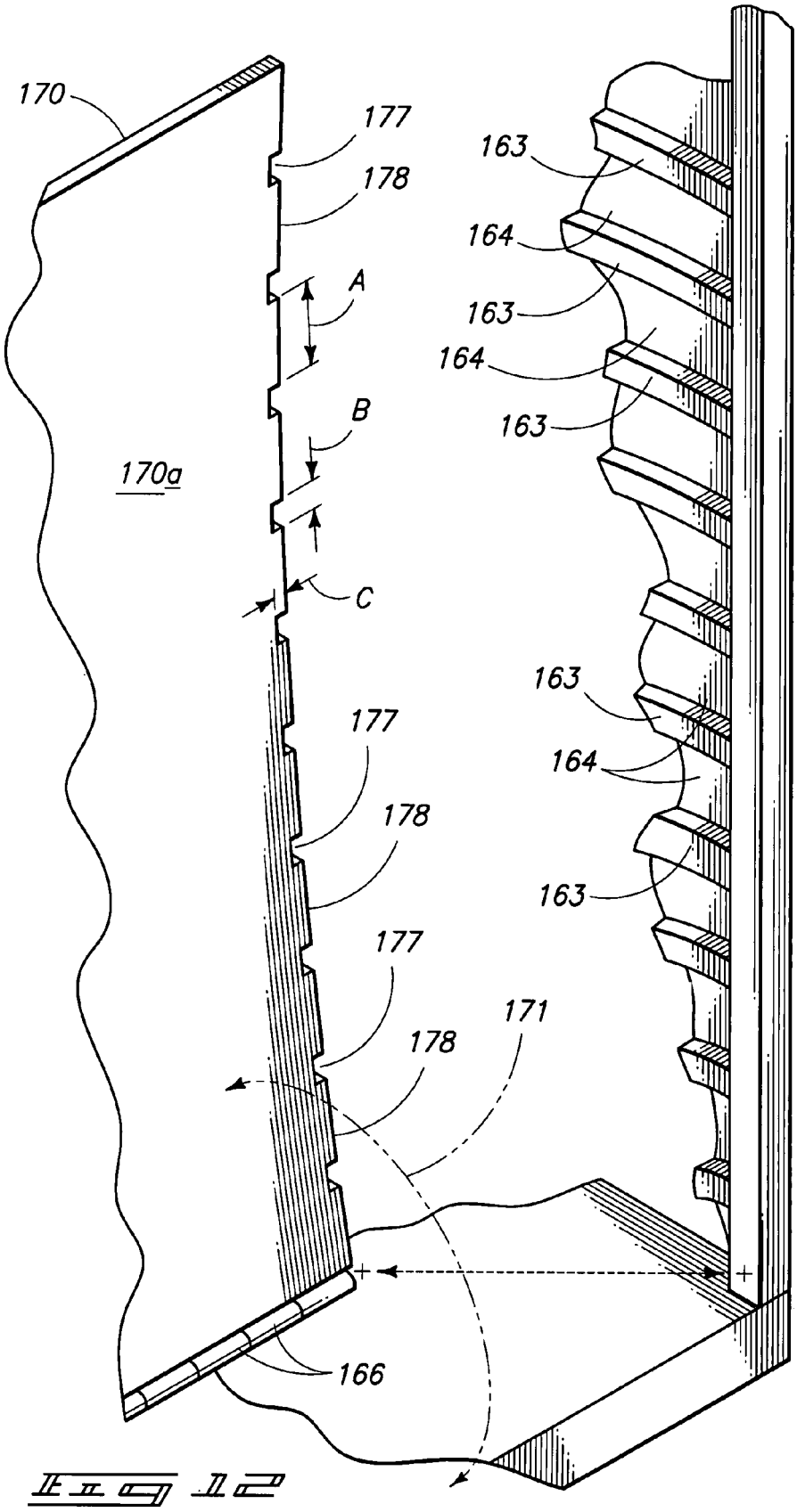
FIG. 12 is a perspective view of one embodiment of a compactor and groove system in the feed hopper that may be utilized in embodiments of this invention.

FIG. 12 is a perspective view of one embodiment of a compactor 170 and groove system in the feed hopper that may be utilized in embodiments of this invention. FIG. 12 is a detail of compactor 170 with compactor surface 170*a*, hinge 166 about which compactor 170 pivots. Protrusions 163 in hopper wall surfaces 164 are shown on the inner side of the hopper wall which is in the interior cavity of the hopper. The protrusions 163 correspond in the location and size to grooves 177 in the side wall of the compactor 170, with protrusions 178 in compactor 170 corresponding in size and location to the area between protrusions 163 on hopper wall.

Each of the grooves 177 have a height B and a depth C with distance A between them. It will be appreciated by those of ordinary skill in the art that any one of a number of different sizes, portions and angles of grooves in protrusions may be utilized in practicing in embodiments of this invention, with no one in particular being required. It is generally desirable that there be a lower tolerance for protrusions 163 within grooves 177 so that paper and other material being moved or compacted does not get wedged or caught between the inner surface of the hopper walls and the sidewalls of compactor 170.

Figure 13:
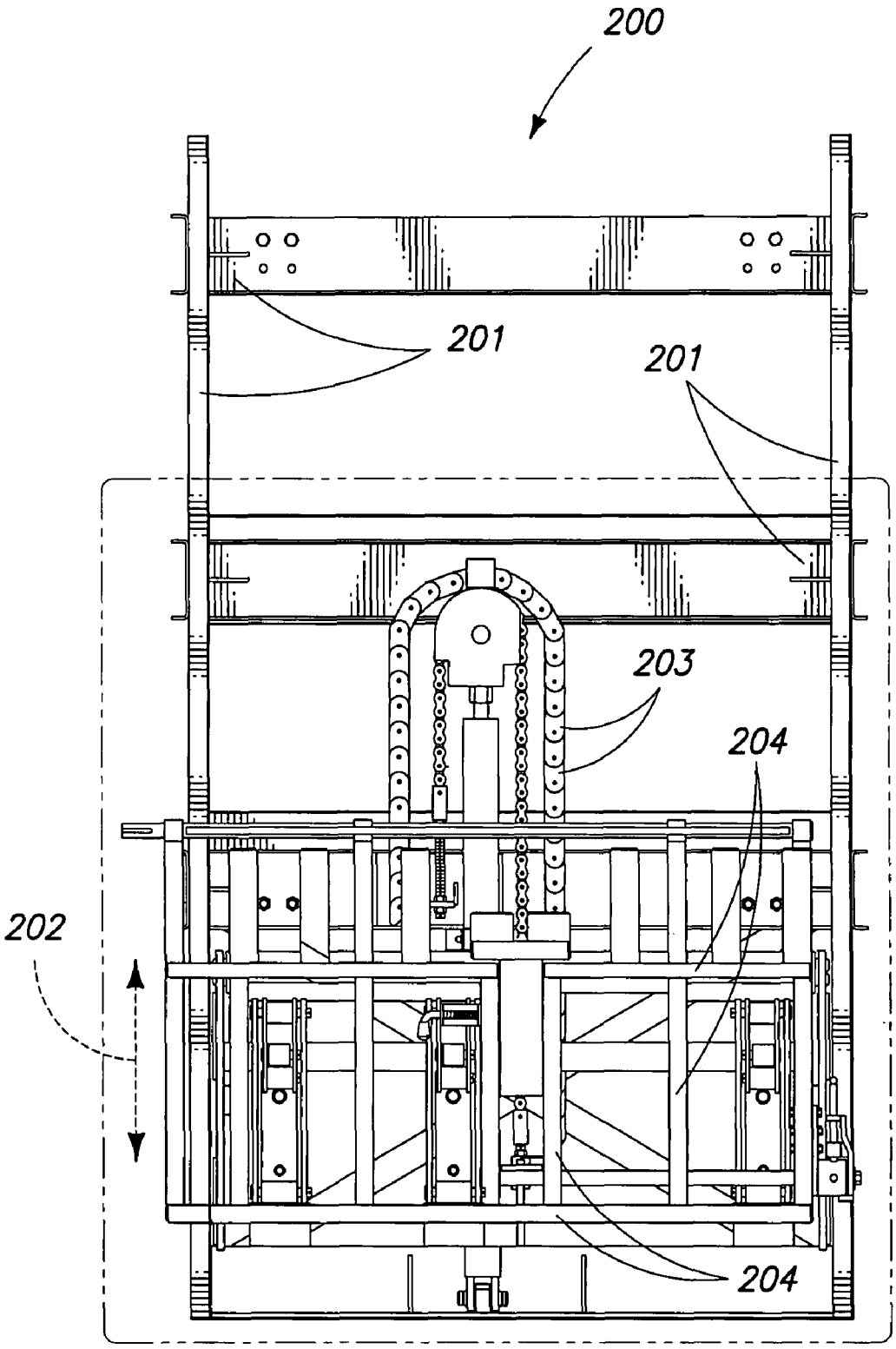
FIG. 13 is an elevation view of an example of an embodiment of a lift system that may be utilized in lifting the material container carriage to dump the material into the hopper, as contemplated by some embodiments of this invention.

FIG. 13 is an elevation view of an example of an embodiment of a lift system that may be utilized in lifting the material container carriage to dump the material into the hopper, as contemplated by some embodiments of this invention.

FIG. 13 illustrates lift assembly 200 and lift assembly framework 201, chain drive 203 and carriage framework 204. Arrow 202 indicates the relative movement of carriage framework relative to the lift assembly framework 201. It will be appreciated that there are a number of different lift assemblies and configurations that may be utilized in practicing different aspects in embodiments of this invention, with no one in particular being required.

Figure 14:
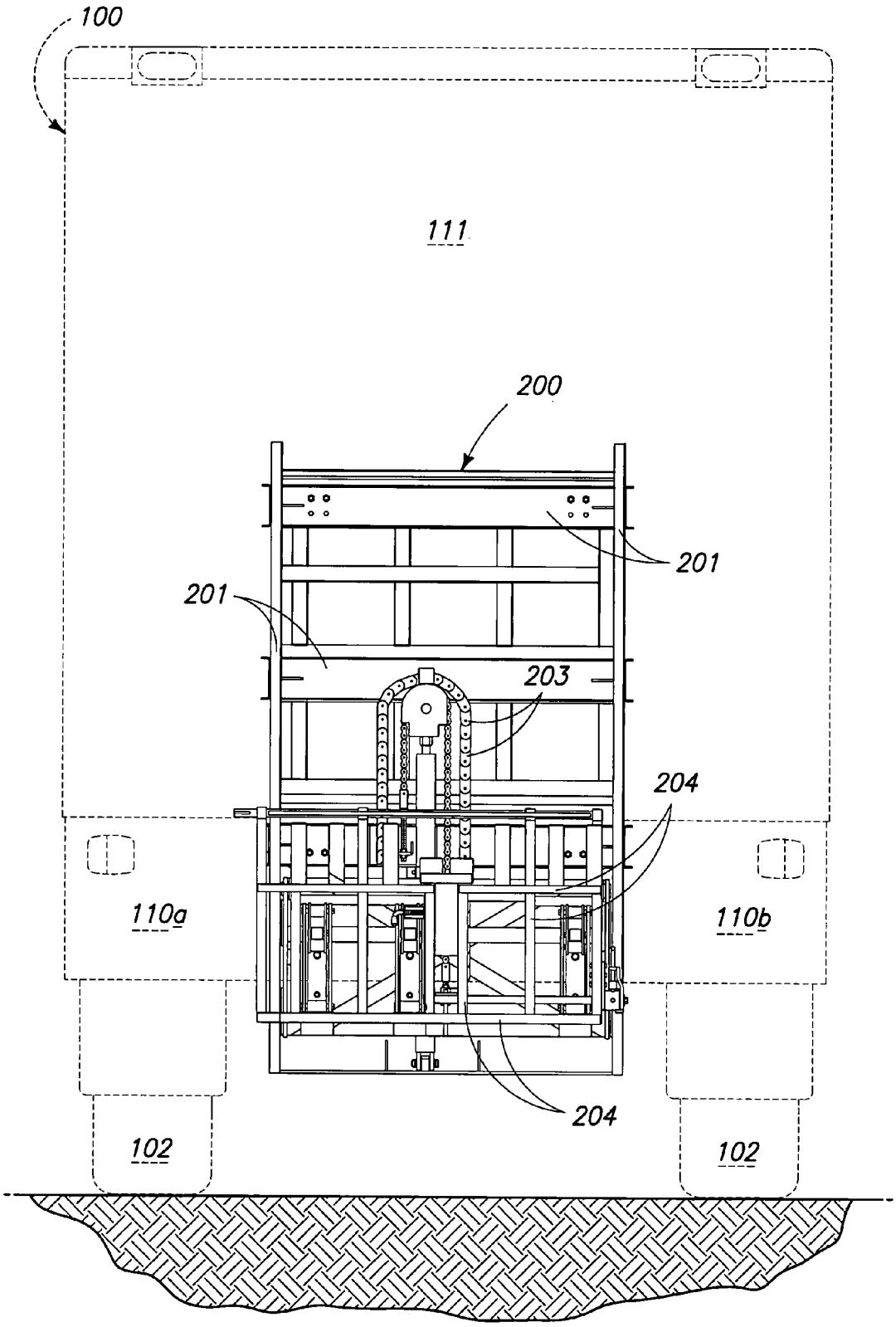
FIG. 14 is an elevation view of the example of the embodiment of the lift system illustrated in FIG. 13 has positioned on the rear end of a vehicle.

FIG. 14 is an elevation view of the example of the embodiment of the lift system illustrated in FIG. 13 as positioned on or toward the rear end of the enclosure or vehicle. FIG. 14 illustrates the lift assembly shown in FIG. 13 mounted on, at or near the rear of a vehicle 100. Rear wall 111 is provided for security and the lift assembly may be provided recessed therein so that when the truck is closed there is no access to the interior or to the lift assembly 200—it is secured. Rear bumper first portion 110*a* and second portion 110*b* are shown and vehicle tires 102 are shown at the ground level.

Figure 15:
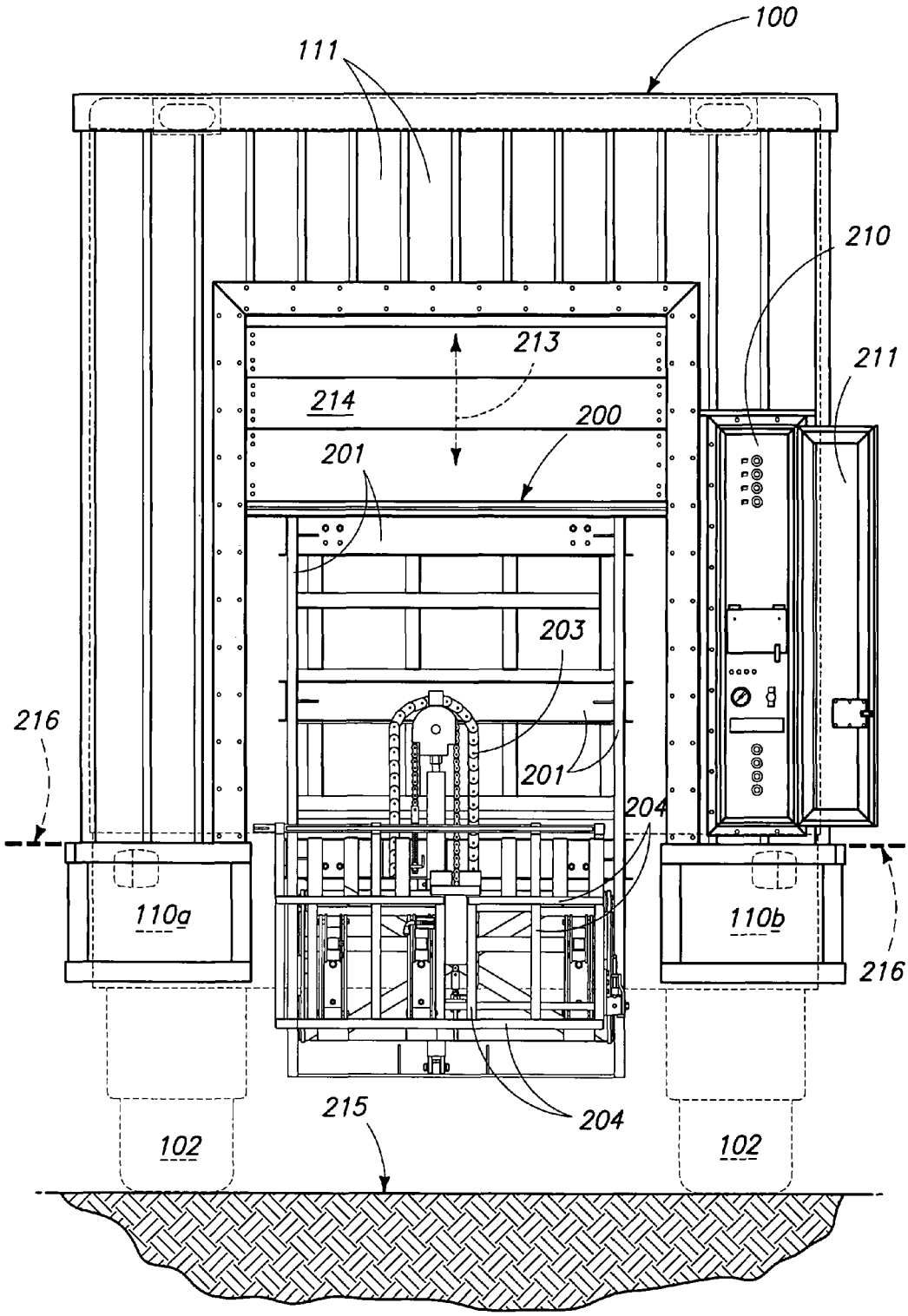
FIG. 15 is a rear elevation view of one embodiment of a vehicle which may be utilized in practicing aspects of this invention, which illustrates security that may be provided by embodiments of this invention.
Figure 11:
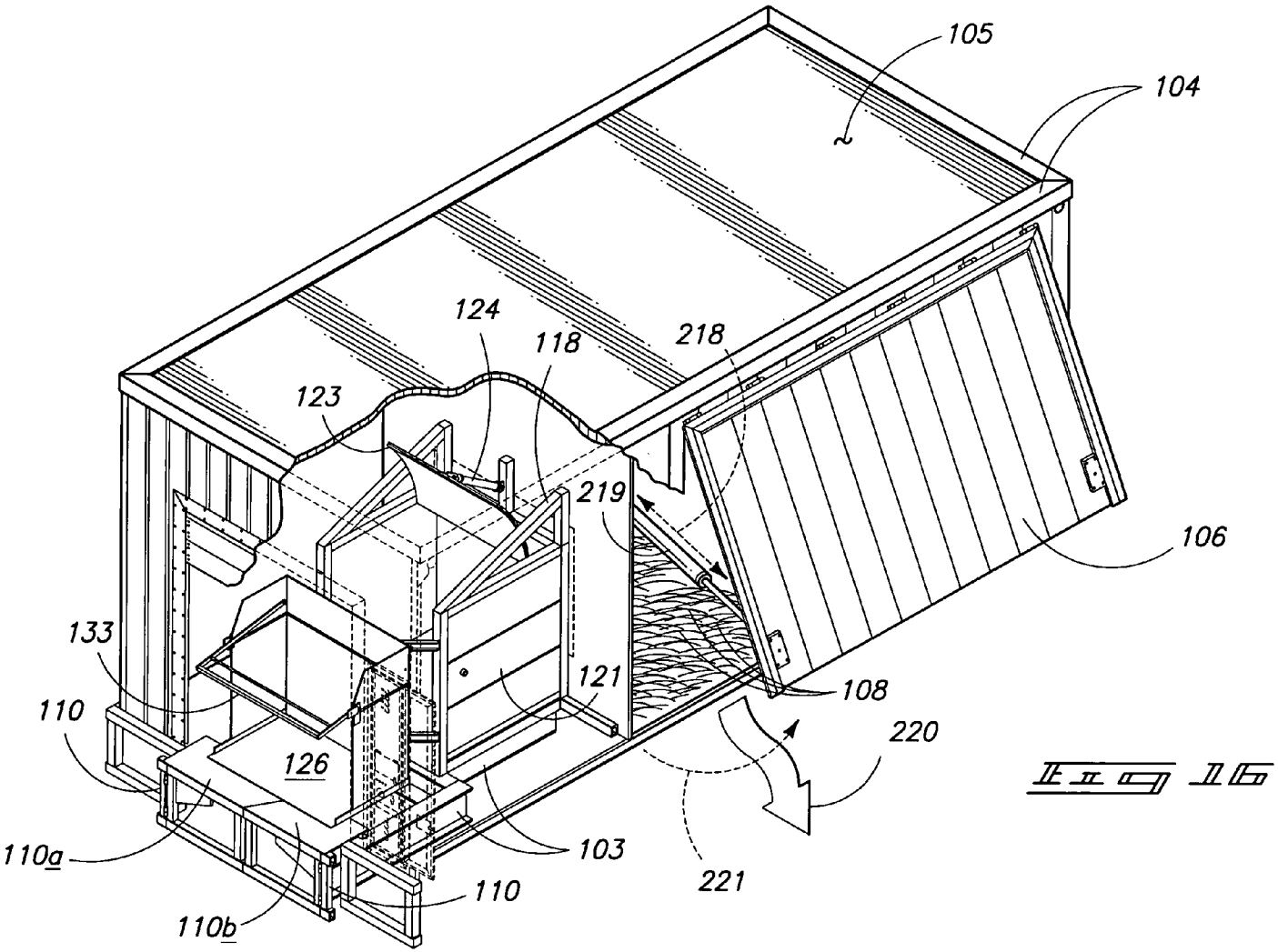
Figure 11:
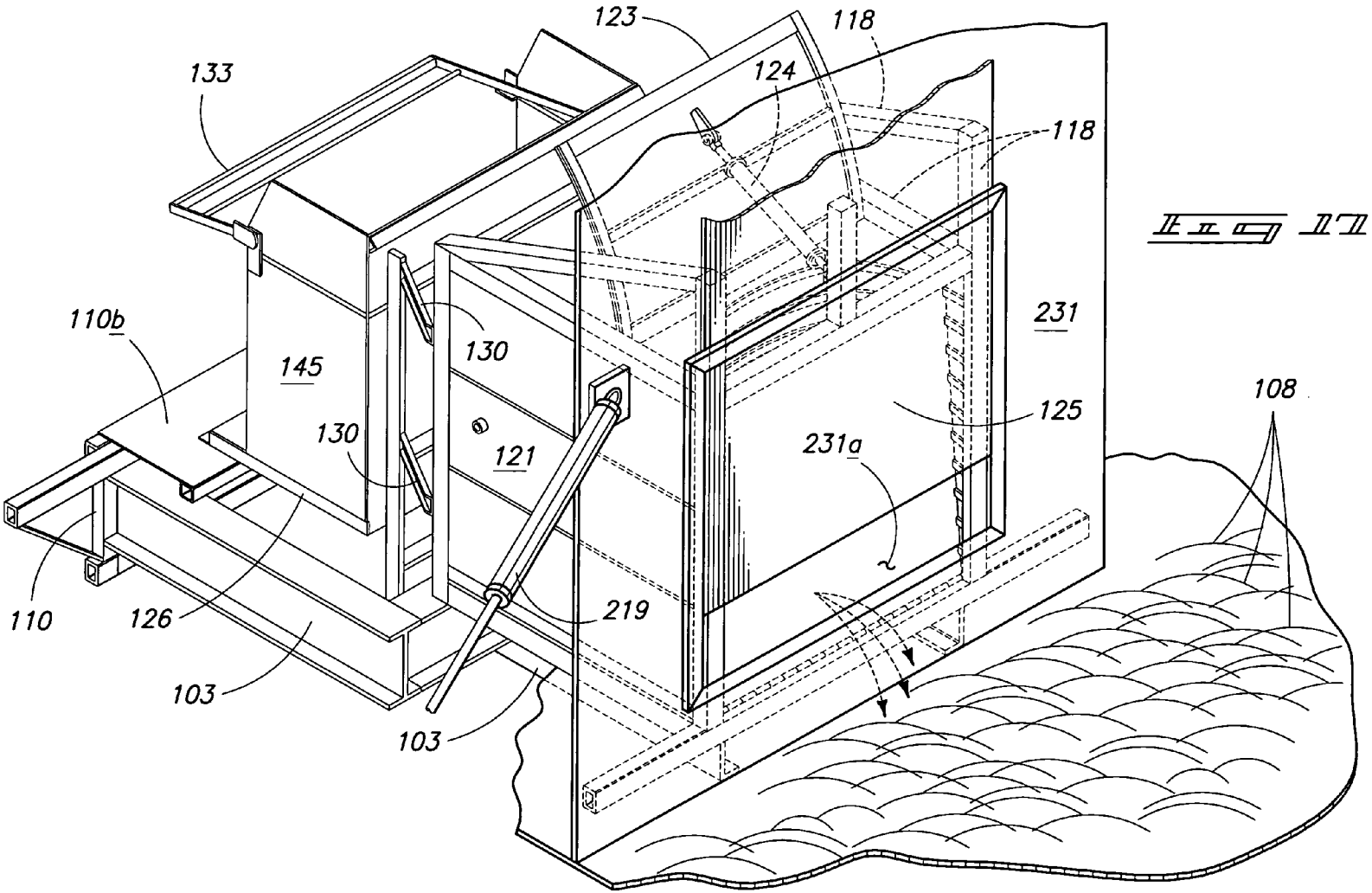

FIG. 15 is a rear elevation view of one embodiment of a vehicle which may be utilized in practicing aspects of this invention, which illustrates aspects of the security that may be provided by this invention. FIG. 15 better illustrates rear wall 111 at the rear end of the vehicle 100, loading dock level 216, first bumper portion 110*a* and second bumper portion 110*b*. Ground level 215 is shown with vehicle tires 102 supporting the vehicle 100 on ground level 215. The lift assembly 200 is shown at the rear of the truck with sliding door 214 able to slide over it to close the aperture in the rear of the truck, with part of the sliding movement as indicated by arrow 213. Control panel 210 is shown as exposed only when control panel door 211 is unlocked and rotated outwardly to provide secure access to control the various aspects and operations of the security material handling vehicle system illustrated in this figure.

The sliding door 214 may be electronically or manually slid down and preferably completely encloses the hopper and material container carriage such that entry may not be gained into the rear portion of the enclosure, the material feed portion of the enclosure, for increased security. The increased security may be at least twofold in some embodiments of the invention, namely it prevents entry into the material feed portion of the enclosure and it prevents material from falling or blowing out of the material loading portion of the enclosure.

FIG. 16 is perspective view of a vehicle container or box which may be utilized in some embodiments of this invention, illustrating one example of how the container sidewall may be opened to allow material to be dumped or removed from the container or enclosure. FIG. 16 illustrates an example of another feature which may be utilized in embodiments of this invention wherein truck container sidewall 106 is pivotally mounted to the truck container 104 such that hydraulic ram 219 maybe utilized to move vehicle sidewall 106 outwardly at its bottom end to allow the removal of material 108 contained within the inner cavity of the material storage portion of the enclosure. Arrow 218 shows the movement provided by hydraulic cylinder 219 to move vehicle sidewall 106 outwardly at its bottom end and arrow 220 shows the movement of the material 108 out of the interior cavity of the material storage portion of the enclosure. In order to achieve the movement of the material 108 out of the inner cavity, any one of a number of different mechanisms or human intervention may be utilized, such as with what is generally referred to in the industry as a walking floor (if a mechanism is preferred). The sidewall 106, or side wall portion, is pivotally mounted to the enclosure and configured to open at a lower side, and which combines with the walking floor within the storage portion of the enclosure to easily remove material from the storage portion, or storage compartment, of the enclosure.

The flow of the material in this embodiment of the invention would start in material container which is located either on the ground or on a loading dock. If on a loading dock, the material containers would be rolled or moved across the vehicle bumper 110 and into the carriage, resting on the carriage bottom portion 126. Retainer bar 133 within the placed over the material containers. From there the carriage would be lifted and tilted to dump the material into the hopper as hopper top 123 is lifted to allow material to be dumped therein. Once the hopper is filled to the desired level, the hopper lid 123 is lowered and may provide some compacting depending on how high the material is within the hopper at the time the hopper lid 123 is lowered. Then the sliding door (shown in other figures) is slid or moved upwardly or in such a way to open the aperture between the hopper and the storage compartment) and the compactor, which is shown in other figures, is raised and pivoted about its axis. This compacts and/or moves the material in the hopper through the aperture into the storage compartment. It will be appreciated by those of ordinary skill in the art that sufficient power may be utilized by the hydraulics or other way of powering or moving the compactor, that the entire storage compartment may be filled from the location on or near the floor level of the storage compartment of the vehicle.

FIG. 17 is a rear perspective view of the hopper feed system relative to the interior cavity of the enclosure, illustrating material being compacted or pushed into the interior cavity of the vehicle container. FIG. 17 illustrates sliding door slid partially up into a position which would allow material to be pushed or moved from the interior cavity of the hopper to the storage compartment. Material 108 is shown on the floor in the storage compartment and wall 231 and wall aperture 231*a* are shown, along with hydraulic cylinder 219, vehicle framework 103, material container carriage 145, carriage bottom 126, vehicle bumper 110 and second portion 110*b*, vehicle bumper 110, retainer bar 133, connector framework 130, hopper wall 121, hopper top 123, hydraulic cylinder 124, and hopper framework 118.

Figure 18:
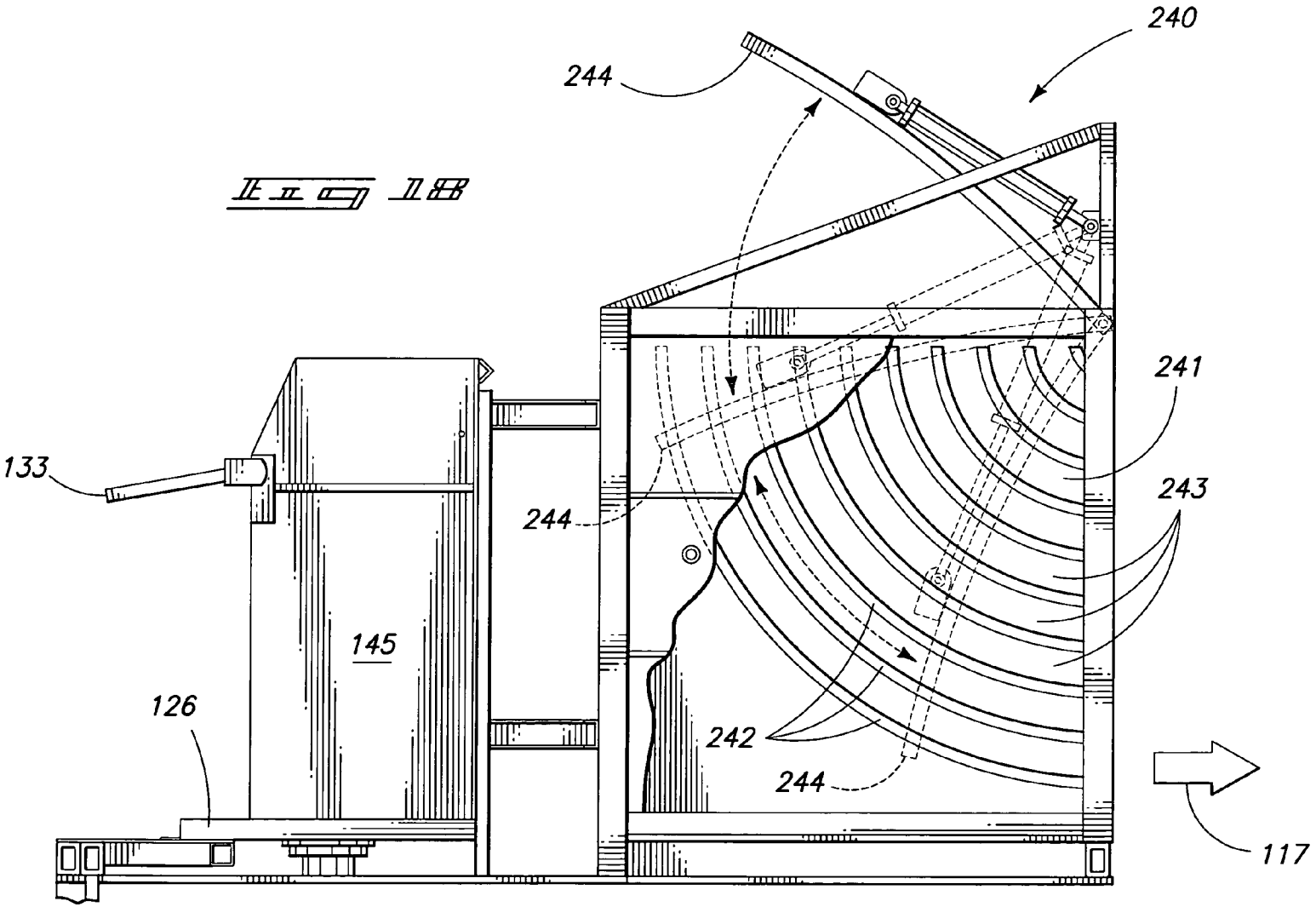
FIG. 18 is a side elevation view of another example of a hopper feed system which may be utilized in some embodiments of this invention, showing the compactor pivoting from an upper side of the hopper.
Figure 11:
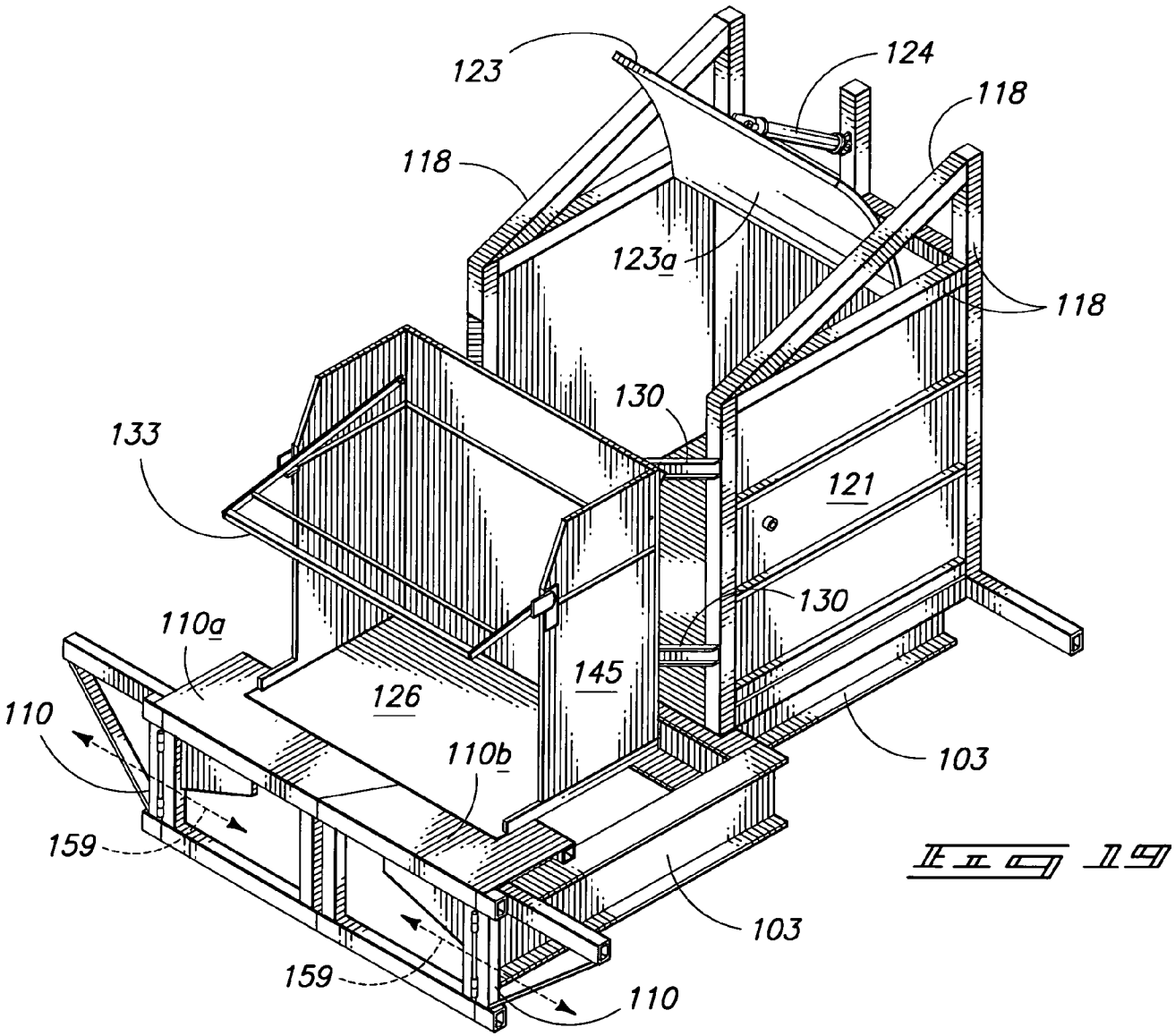

FIG. 18 is a side elevation view of another example of a hopper feed system which may be utilized in some embodiments of this invention, showing the compactor pivoting from a top side of the hopper. FIG. 18 illustrates material container carriage 145 with bottom 126, compactor 244 pivotally mounted to hopper 240, and illustrates how a compactor may be utilized near the top of the hopper or pivotally mounted near the top of the hopper to compact and/or move material, with protrusions 242 in hopper sidewall which would interact with grooves in compactor 244 in similar fashion to that shown in FIG. 12. Arrow 117 illustrates where material would be exiting the hopper through a hopper aperture after a sliding door (not shown in this figure) is moved upwardly to open the aperture, with the material being moved or compacted into the storage compartment.

FIG. 19 is a perspective view of another example of a secure material handling system which may be utilized in practicing this invention, wherein the bumper portions slide relative to the enclosure and relative to one another. FIG. 19 illustrates another example of an embodiment of the invention wherein the relative movement of the vehicle bumper 110 is by sliding of the bumper 110 relative to the vehicle framework 103 as indicated by arrows 159. All like numbered items in FIG. 19 are the same as described in prior figures relative to the same items will not be restated here to avoid repetition.

The security feature of embodiments of this invention is a new direction in material handling and security with access to the interior of the enclosure being prevented and with controls and preventative equipment being such items as a hydraulic cylinder 219 retaining the side wall 106 in place when in the closed or secured position, as shown and described more fully in FIG. 16. The door at the rear end may preferably also be secured with hydraulic cylinders and an electric or other motor may be utilized for the hydraulics utilized in embodiments of the invention. It should further be noted that the walls of the enclosure are preferably double walled construction with extruded aluminum.

As will be appreciated by those of reasonable skill in the art, there are numerous embodiments to this invention, and variations of elements, steps and system components which may be used, all within the scope of this invention.

In one embodiment for example, a rear loading material handling apparatus may be provided which comprises: a framework; an enclosure attached to the framework, the enclosure including a front end, a rear end and a interior cavity with a material loading portion toward the rear end and a storage portion near the front end; a material hopper mounted within the material loading portion of the enclosure, the hopper including an inlet configured to receive material and an outlet into the storage portion of the enclosure; a material container carriage movably mounted within the material loading portion of the enclosure and configured to receive at least one material container through the rear end of the enclosure and deposit material in the at least one material container into the hopper; a material movement device within the hopper configured to move deposited material from the hopper through the outlet into the storage portion of the enclosure.

In a further embodiment of that recited in the preceding paragraph, a rear loading material handling apparatus may be further provided wherein the material container carriage is configured for movement from a ground-level to the material loading portion of the enclosure. A further embodiment may further comprising a bumper movably mounted to the framework such that it can be moved to provide for passage of material containers when the material container carriage is at ground level. A still further possible embodiment may be such aa rear loading material handling apparatus and further wherein the bumper is comprised of a first bumper portion pivotally mounted to the framework and configured to rotate clockwise, and a second bumper portion pivotally mounted to the framework and configured to rotate counterclockwise. Instead of being pivotally attached, the bumpers may slidably attached or mounted to the framework.

As embodiments of this material handling apparatus are intended to be mobile and for use in combination with trucks, a further embodiment may be wherein the framework is one of attached to and integral with a vehicle.

In a further embodiment which includes unloading features, a rear loading material handling apparatus may be provided which further comprises: a side wall portion pivotally mounted to the enclosure and configured to open at a lower side; and a walking floor within the storage portion of the enclosure configured to move material therein toward the side wall portion pivotally mounted to the enclosure and configured to open at a lower side.

In numerous embodiments of the foregoing, material loading portion and the storage portion are completely within the enclosure and/or further wherein the enclosure is configured to prevent unauthorized entry into any part thereof.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted literally and in accordance with the doctrine of equivalents.

The invention claimed is:

1. A rear loading material handling apparatus mounted on a wheeled chassis of a truck or a trailer, comprising:

a wheeled chassis with a front end oriented in the direction of travel;

a framework mounted on the front end of the wheeled chassis;

an enclosure attached to the framework, the enclosure including a front end, a rear end and an interior cavity with a material loading portion toward the rear end and a storage portion toward the front end, wherein the material loading portion includes an area configured to receive at least one material container;

the enclosure including a side wall portion pivotally mounted to the enclosure and configured to open at a lower side, and the enclosure further including a floor within the storage portion of the enclosure configured to move material therein toward the side wall portion pivotally mounted to the enclosure;

a hopper mounted within the material loading portion of the enclosure, the hopper including an inlet configured to receive material and an outlet to the storage portion of the enclosure;

a material container carriage movably mounted fully within the material loading portion of the enclosure and configured to receive the at least one material container through the rear end of the enclosure and deposit material from the at least one material container into the hopper;

a material movement device within the hopper configured to move the material from the hopper through the outlet into the storage portion of the enclosure;

further wherein the material container carriage is configured for movement from a ground-level to the material loading portion of the enclosure; and further comprising a bumper movably mounted to the framework such that it can be moved to provide for passage of material containers when the material container carriage is at ground level.

2. A rear loading material handling apparatus mounted on a wheeled chassis of a truck or a trailer, as recited in claim 1 and further wherein the bumper is comprised of a first bumper portion pivotally mounted to the framework and configured to rotate clockwise, and a second bumper portion pivotally mounted to the framework and configured to rotate counterclockwise.

3. A rear loading material handling apparatus mounted on a wheeled chassis of a truck or a trailer, as recited in claim 1, and further wherein the bumper is comprised of a first bumper portion and a second bumper portion, each slidably mounted to the framework to slide away from each other to provide for passage of material containers when the material container carriage is at ground level.

4. A rear loading material handling apparatus mounted on a wheeled chassis of a truck or a trailer, as recited in claim 1, and further wherein the framework is one of attached to and integral with a vehicle.

5. A rear loading material handling apparatus mounted on a wheeled chassis of a truck or a trailer, as recited in claim 1, and further wherein the material loading portion and the storage portion are completely within the enclosure.

6. A rear loading material handling apparatus mounted on a wheeled chassis of a truck or a trailer, as recited in claim 1, and further wherein the enclosure is configured to prevent unauthorized entry into any part thereof.

7. A rear loading material handling apparatus mounted on a wheeled chassis of a truck or a trailer, as recited in claim 1 and further wherein the material movement device is a compactor pivotally mounted relative to the hopper.

8. A rear loading material handling apparatus mounted on a wheeled chassis of a truck or a trailer, as recited in claim 1 and further wherein further the bumper is movably mounted to the framework such that it provides for passage of material containers when the material container carriage is at an elevated loading dock level.

* * * * *